United States Patent [19]

Sayles

[11] 4,316,359

[45] Feb. 23, 1982

[54] METHOD OF IMPARTING HYPERGOLICITY TO NON-HYPERGOLIC ROCKET PROPELLANTS

[75] Inventor: David C. Sayles, Huntsville, Ala.

[73] Assignee: The United States of America as represented by the Secretary of the Army, Washington, D.C.

[21] Appl. No.: 72,733

[22] Filed: Sep. 7, 1979

[51] Int. Cl.[3] ..... C06D 5/08

[52] U.S. Cl. ..... 60/212; 60/211; 60/215; 60/214

[58] Field of Search ..... 60/211, 214, 212, 219, 60/215

[56] References Cited

U.S. PATENT DOCUMENTS

| | | | |
|---|---|---|---|
| 2,573,471 | 10/1951 | Malina et al. | 60/211 |
| 2,993,334 | 7/1961 | Burton | 60/212 |
| 2,994,190 | 8/1961 | Burton | 60/214 |
| 2,994,191 | 8/1961 | Hamilton | 60/214 |
| 3,095,693 | 7/1963 | Wamser | 60/214 |

OTHER PUBLICATIONS

Hawley, "The Condensed Chemical Dictionary", 9th Ed., p. 51, Van Nostrand Reinhold Company, (1977), N.Y.

*Primary Examiner*—Edward A. Miller
*Attorney, Agent, or Firm*—William G. Gapcynski; Arthur I. Spechler; Jack Voigt

[57] ABSTRACT

Disclosed is a method of converting non-hypergolic, liquid, rocket propellants into hypergolic propellants. The method to accomplish the conversion relates to the use of ammonium metavanadate as an additive to the liquid oxidant, such as, red fuming nitric acid (RFNA). The RFNA with additive is hypergolic with the usual fuels with which RFNA has been employed where a separate ignition system is normally required. RFNA with additive is also hypergolic with fuels which have been non-hypergolic and which have not been so used in the past with RFNA. These additional fuel blends include a fuel material selected from turpentine, aniline, triethylamine, furfuryl alcohol or blends of these fuel materials.

8 Claims, No Drawings

METHOD OF IMPARTING HYPERGOLICITY TO NON-HYPERGOLIC ROCKET PROPELLANTS

DEDICATORY CLAUSE

The invention described herein may be manufactured, used, and licensed by or for the Government for governmental purposes without the payment to me of any royalties thereon.

BACKGROUND OF THE INVENTION

Hypergolicity or self-ignition is a very desirable characteristic for biliquid propellants to have because this characteristic would eliminate the need for a separate ignition system to initiate the combustion of the propellant. The biliquid hypergolic propellant is comprised of an oxidizer and fuel which self ignites when brought together in a device such as a rocket engine combustion chamber. Mere hypergolic ignitability is, however, not adequate for successful performance since the ignition delay needs to be sufficiently short so that the rocket engine does not undergo a "hard start". The hypergolic ignitability characteristic must be capable of bringing about smooth combustion, and have "multiple start and restart" capabilities. For acceptable hypergolicity, an ignition delay of less than 50 milliseconds is considered essential.

Biliquid propellant fuels have been generally grouped into the following classes (1) liquid hydrogen and light elements, (2) borohydrides, (3) organic fuels, and (4) nitrogen hydrides. Examples of light elements are lithium, beryllium, boron, and aluminum. Examples of borohydrides are diborane ($B_2H_6$) and pentaborane ($B_5H_9$). Liquid organic fuels are all liquid fuels containing carbon and hydrogen. Examples of liquid organic fuels are alcohols, light hydrocarbon, unsymmetrical dimethylhydrazine (UDMH), and diethylenetriamine (DETA). Examples of nitrogen hydrides are ammonia ($NH_3$) and hydrazine ($N_2H_4$).

The mere fact a fuel is hypergolic with a certain oxidizer does not establish a preferred status for its use as a biliquid hypergolic propellant. As indicated by the above classes of available biliquid fuels a wider selection is available for use; however, the atoms most useful as an oxidizer for use in a biliquid propellant system are oxygen and fluorine. Certain compounds containing oxygen and/or fluorine are also useful as oxidizers. For example: chlorine trifluoride, nitrogen trifluoride, red fuming nitric acid, inhibited red fuming nitric acid, and hydrogen peroxide are oxidizing compounds of the described type. More recently more complex compounds have been synthesized.

Advantageous would be an oxidizer which could be rendered more useful for use with conventional fuels or whose oxidizer function could be improved so that the oxidizer could then be useful with other materials which normally have not been considered fuel candidates. For example, natural products or mixture thereof which are endemic in a particular country could then become useful fuels and provide low-cost liquid propellant compositions when used with the oxidizer when modified.

An object of this invention is to provide a method of imparting hypergolicity to non-hypergolic rocket propellants.

Another object of this invention is to provide a modified oxidizer which has the capacity to impart hypergolicity to a fuel-oxidizer combination which otherwise is non-hypergolic.

A further object of this invention is to provide biliquid hypergolic propellants which have an ignition delay of less than 50 milliseconds.

Still a further object of this invention is to provide a modified oxidizer for use in combination with fuels to yield repeatability of ignition times and to enable variations of modified oxidizer-to-fuel ratios to be selected wherein only a marginal effect to ignition times result.

SUMMARY OF THE INVENTION

Ammonium metavanadate is employed as an additive to red fuming nitric acid (RFNA) in concentrations of 1% on a weight basis (1% w/w) to yield a modified oxidizer which is hypergolic with a wide variety of fuel compositions selected from the members of the group consisting of turpentine, aniline, triethylamine, furfuryl alcohol, and blends of said members of said group.

The modified oxidizer when employed with otherwise non-hypergolic fuels renders the fuel-modified oxidizer combination hypergolic even with variations of modified oxidizer-to-fuel ratios to result in only marginal effect to the ignition times. The actual result is that ammonium metavanadate, as an additive to RFNA, effects a major reduction in the ignition delay times of chemicals that would not normally be acceptable as rocket fuels because of their lack of hypergolicity.

DESCRIPTION OF THE PREFERRED EMBODIMENT

Ammonium metavanadate is added to RFNA in concentrations of about 1% on a weight basis, (1% w/w), to provide a means of converting a wide variety of fuels into potential, biliquid hypergolic propellant systems. The method of this invention, thus, permits the use of a wide variety of natural products or mixtures which are endemic in a particular country to be used as rocket propellants, and, in this manner, provide low-cost liquid propellant compositions, which have acceptably short ignition times to be classed as hypergolic. The fuel compositions can be selected from the group consisting of turpentine, aniline, triethylamine, furfuryl alcohol, or blends of these fuel compositions.

With the selected fuels, unusually good repeatability of the ignition times were found with RFNA containing ammonium metavanadate. Further, variations of oxidizer-to-fuel ratio had only a marginal effect on the ignition times.

The ignition times which were measured for various turpentine-aniline, turpentine-furfuryl alcohol, and turpentine-triethylamine blends are presented in Table I. The effect of the incorporation of ammonium metavanadate into the corresponding fuel blends are depicted in Table II. The ignition times were determined on predetermined amounts (in volume ratios) of rocket fuel and modified oxidizer that were simultaneously introduced into a combustion chamber where hypergolic ignition occurred.

TABLE I

IGNITION TIMES* OF FUELS & BLENDS

| FUEL (BLEND) | BLEND RATIO | **OXIDIZER-FUEL RATIO (BY VOLUME) | IGNITION TIME (MS) |
|---|---|---|---|
| Turpentine (Neat) | | 0.8–1.4 | Erratic |
| Turpentine-Aniline | 75/25 | 2.0 | 84 |
| Turpentine-Aniline | 50/50 | 1.0 | 100 |

TABLE I-continued

IGNITION TIMES* OF FUELS & BLENDS

| FUEL (BLEND) | BLEND RATIO | **OXIDIZER-FUEL RATIO (BY VOLUME) | IGNITION TIME (MS) |
|---|---|---|---|
| Turpentine-Aniline | 25/75 | 3.3 | 83 |
| Turpentine-Triethylamine | 75/25 | 1.0 | 107 |
| Turpentine-Furfuryl Alcohol | 75/25 | 2.0 | 130 |

*As determined by the Open Cup Method.
**RFNA (containing 21% $N_2O_4$).

TABLE II

EFFECT OF AMMONIUM METAVANADATE ON IGNITION TIMES OF ROCKET FUELS & BLENDS

| FUEL (BLEND) | BLEND RATIO | *OXIDIZER-FUEL RATIO (BY VOLUME) | IGNITION TIMES (MS) |
|---|---|---|---|
| Turpentine (Neat) | | 1.25 | 49. |
| Turpentine-Aniline | 75/25 | 3.3 | 43. |
| Turpentine-Aniline | 50/50 | 2.0 | 29. |
| Turpentine-Aniline | 25/75 | 2.0 | 20. |
| Turpentine-Triethylamine | 75/25 | 3.3 | 10. |
| Aniline | | 2.5 | 17. |
| Turpentine-Furfuryl Alcohol | 75/25 | 2.0 | 20. |

*RFNA (containing 21% $N_2O_4$).

The experimental results shown in Table II, as compared with the results in Table I, conclusively prove the effectivity of ammonium metavanadate as an additive to RFNA for effecting a major reduction in the ignition delay times of chemicals that would not normally be acceptable as rocket fuels because of their lack of hypergolicity. Thus, the data which derive from the results contained in the Tables illustrate that fuel blends which had ignition delay times well above the maximum (greater than 50 milliseconds) could be changed to hypergolic rocket propellants with shortened ignition delay times with very acceptable limits when RFNA with metavanadate additive was used.

I claim:

1. A method of imparting an acceptable hypergolicity to non-hypergolic rocket fuels comprising:

(i) providing a non-hypergolic rocket fuel selected from the group consisting of turpentine, aniline, triethylamine, furfuryl alcohol and predetermined blend ratios of the same;

(ii) providing a liquid oxidizer of red fuming nitric acid containing about 21% $N_2O_4$;

(iii) adding ammonium metavanadate in concentrations of about 1% on a weight-to-weight basis to said liquid oxidizer to yield a modified oxidizer; and, (iv) introducing simultaneously into a combustion chamber predetermined amounts of said rocket fuel and said modified oxidizer to provide an oxidizer to fuel ratio by volume from about 1.0 to 1.0 to about 3.3 to 1.0, said predetermined amounts of said rocket fuel and said modified oxidizer, when combined, producing an acceptable hypergolicity with an ignition delay time of less than 50 milliseconds.

2. The method of claim 1 wherein said non-hypergolic fuel selected is neat turpentine, said predetermined amounts of said fuel and said modified oxidizer provides an oxidizer-to-fuel ratio by volume of about 1.25 to 1.0, and wherein said ignition delay time is about 49 milliseconds.

3. The method of claim 1 wherein said non-hypergolic fuel selected is turpentine and aniline in a blend ratio of about 75 parts turpentine to about 25 parts aniline, said predetermined amounts of said fuel and said modified oxidizer provides an oxidizer-to-fuel ratio by volume of about 3.3 to 1.0, and wherein said ignition delay time is about 43 milliseconds.

4. The method of claim 1 wherein said non-hygergolic fuel selected is turpentine and aniline in a blend ratio of about 50 parts turpentine to about 50 parts of aniline, said predetermined amounts of said fuel and said modified oxidizer provides an oxidizer-to-fuel ratio by volume of about 2.0 to 1.0, and wherein said ignition delay time is about 29 milliseconds.

5. The method of claim 1 wherein said non-hypergolic fuel selected is turpentine and aniline in a blend ratio of about 25 parts turpentine to about 75 parts aniline, said predetermined amounts of said fuel and said modified oxidizer provides an oxidizer-to-fuel ratio by volume of said 2.0 to 1.0, and wherein said ignition delay time is about 20 milliseconds.

6. The method of claim 1 wherein said non-hypergolic fuel selected is turpentine and triethylamine in a blend ratio of about 75 parts turpentine to about 25 parts triethylamine, said predetermined amounts of said fuel and said modified oxidizer provides an oxidizer-to-fuel ratio by volume of about 3.3 to 1.0, and wherein said ignition delay time is about 10 milliseconds.

7. The method of claim 1 wherein said non-hypergolic fuel selected is neat aniline, said predetermined amounts of said fuel and said modified oxidizer provides an oxidizer-to-fuel ratio by volume of about 2.5 to 1.0, and wherein said ignition delay time is about 17 milliseconds.

8. The method of claim 1 wherein said non-hypergolic fuel selected is turpentine and furfuryl alcohol in a blend ratio of about 75 parts turpentine to about 25 parts furfuryl alcohol, said predetermined amounts of said fuel and said modified oxidizer provides an oxidizer-to-fuel ratio by volume of about 2.0 to 1.0, and wherein said ignition delay time is about 20 milliseconds.

* * * * *